United States Patent [19]

Vuaille

[11] 3,945,773

[45] Mar. 23, 1976

[54] HYDRAULIC HEADS FOR INJECTION PUMPS AND THE INJECTION PUMPS THEMSELVES

[75] Inventor: André Vuaille, Lyon, France

[73] Assignee: Sigma Diesel, Venissieuz, France

[22] Filed: Aug. 23, 1974

[21] Appl. No.: 500,078

[30] Foreign Application Priority Data

Sept. 5, 1973 France ..... 73.32047

[52] U.S. Cl. ..... 417/494; 417/501

[51] Int. Cl.[2] ..... F04B 7/04; F04B 37/10

[58] Field of Search ..... 417/490, 493, 474, 499, 417/500, 501, 238, 360; 92/171; 123/139 B

[56] References Cited

UNITED STATES PATENTS

| | | | |
|---|---|---|---|
| 3,046,896 | 7/1962 | Minett et al. | 417/499 |
| 3,804,559 | 4/1974 | Staudt et al. | 417/499 |

FOREIGN PATENTS OR APPLICATIONS

| | | | |
|---|---|---|---|
| 171,353 | 5/1960 | Sweden | 417/494 |
| 482,841 | 4/1938 | United Kingdom | 417/494 |
| 843,046 | 8/1960 | United Kingdom | 417/494 |
| 1,365,247 | 5/1964 | France | 417/494 |

*Primary Examiner*—Carlton R. Croyle
*Assistant Examiner*—Richard E. Gluck
*Attorney, Agent, or Firm*—Larson, Taylor and Hinds

[57] ABSTRACT

The hydraulic head comprises a cylinder forming a pump chamber and comprising at least one fuel supply orifice formed in its cylindrical wall. A pump piston is adapted to move in said cylinder, and a delivery connector is connected to the cylinder. This connector is provided externally with a shoulder adapted to constitute an axial stop for the hydraulic head, against a support surface of the pump casing comprising housings adapted to receive said hydraulic heads. The delivery connector, comprises, in addition, internally, a delivery valve, the end portion of the cylinder turned towards the delivery connector comprising, on its outer surface, fixing means adapted to cooperate with complementary fixing means provided on the inner surface of a housing of the delivery connector adapted to receive said end portion of the cylinder. Thus, in the fully assembled hydraulic head, said cylinder is directly suspended on the delivery connector.

4 Claims, 1 Drawing Figure

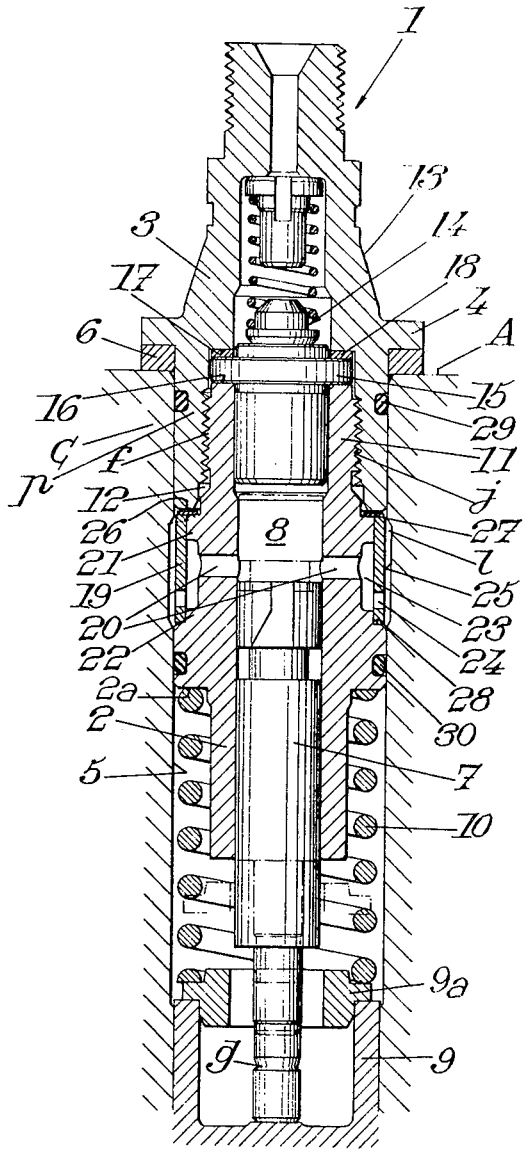
1
13
14
3
18
17
4
A
6
15
16
29
c
f
11
h
j
12
8
27
26
l
21
25
19
23
20
24
22
28
2a
30
2
7
5
10
9a
g
9

HYDRAULIC HEADS FOR INJECTION PUMPS AND THE INJECTION PUMPS THEMSELVES

The invention relates to hydraulic heads for injection pumps, of the type which comprises, on the one hand, a cylinder forming a pump chamber and comprising a fuel supply orifice formed in its cylindrical wall, a pump piston being adapted to move in said cylinder, and on the other hand, a delivery connector connected to the cylinder, this connector being provided externally with a shoulder adapted to constitute an axial stop for the hydraulic head, against a support surface of the pump casing comprising housings adapted to receive the abovesaid hydraulic heads, this delivery connector comprising, in addition, internally, a delivery valve.

The invention relates more particularly, because it is in this case that this application seems to offer the most advantage, but not exclusively, to hydraulic heads for fuel injection pumps called "in line" pumps, that is to say of which the axis of the hydraulic heads are located in a same plane.

It is a particular object of the invention to render the abovesaid hydraulic heads such that they respond to the various exigencies of practice better than hitherto and especially such that they are simpler to produce and that the risks of deformation of the bore of the cylinder on clamping the hydraulic head on the pump casing be reduced.

According to the invention, a hydraulic head of the type defined above is characterised by the fact that the end portion of the cylinder turned towards the delivery connector comprises, on its outer surface, fixing means adapted to cooperate with complementary fixing means provided on the inner surface of a housing of the delivery connector adapted to receive said end portion of the cylinder, so that, in the fully mounted hydraulic head, said cylinder is directly suspended from the delivery connector.

Preferably, fixing means provided at the outer surface of said end portion of the cylinder are constituted by a threading adapted to cooperate with a complementary threading provided inside the delivery connector.

The delivery valve, of the delivery connector, comprises advantageously an outer collar which is clamped between the front wall of the end portion of the cylinder and an inner shoulder of the delivery connector; a sealing-washer is, for example, provided between said collar and the inner shoulder of the delivery connector.

This delivery connector comprises a portion engaged in the housing of the casing of the pump adapted to receive the hydraulic head, and a fluid tight seal is provided between this portion, engaged in a housing, and the wall of the housing, a second level of fluid tightness being formed by a seal arranged directly between the cylinder and said wall of the housing, the one or more fuel in that orifices provided in the wall of the cylinder, being situated axially between the two levels of fluid tightness formed by the abovesaid seals.

Advantageously, the hydraulic head comprises a deflector ring, situated axially at the level of the one or more supply orifices of the cylinder, mounted free in rotation around the cylinder, especially with the interposition in the axial direction of a friction washer.

This deflector ring is advantageously mounted in a housing defined, at its axial end turned towards the delivery connector, by the front end wall of the portion of the connector engaged in the housing.

The invention also relates to fuel injection pumps, for example to in line injection pumps, characterised by the fact that they are equiped with hydraulic heads such as previously defined.

The invention also relates to the cylinders and delivery connectors for such hydraulic heads.

The invention consists, apart from the features discussed above, of certain other features which are preferably utilised at the same time and which will be more explicitely considered below with reference to a prefered embodiment of the invention which will now be described in more detailed manner with reference to the accompanying drawing, but which is to be considered as a non-limiting.

The single FIGURE of this drawing shows, in transverse section, a hydraulic head for an injection pump, according to the invention.

Referring to the drawing, there can be seen a hydraulic head 1, for an injection pump, comprising a cylinder 2 and a delivery connector 3 connected to the cylinder. This connector 3 is provided externally with a shoulder 4 adapted to constitute an axial stop for the hydraulic head 1 against a support surface A of the casing C of the pump, in which are provided housings 5 adapted to receive the hydraulic heads 1. It is to be noted that the shoulder 4 cannot be directly in abutment against the surface A and that a shim 6, as shown in the drawing, may be arranged between said shoulder 4 and the surface A.

Each housing 5 is cylindrical in revolution and has a constant diameter.

A hydraulic head comprising a delivery connector provided with such a shoulder 4, as well as the injection pump equiped with these hydraulic heads, have been described previously in U.S. Pat. No. 3,759,637 granted Sept. 18, 1973.

For all additional information relating to the arrangement of the hydraulic head 1 with respect to the various members of the injection pump, it suffices to refer to this patent.

A pump piston 7 is provided to move slidably and in rotation in the cylinder 2, a pump chamber 8 being formed in this cylinder, above the head of the piston 7. The sliding movements of the piston are actuated by a pusher 9 subject to the action of a cam (not shown) whilst the rotary movements of the piston 7 are actuated by a finger (not shown) intended to be keyed in rotation on the shank of a piston 7 at the level of the grooved *g*. In the drawing, the piston 7 has been shown in full line in its low position and in dashed or broken line in its high position. A helical spring 10 arranged between the shoulder 2*a* of the outer wall of the cylinder 2 and a cup 9*a* supported on the pusher 9, ensures the return of this pusher against the cam (not shown).

The end portion 11 of the cylinder 2 which faces or is turned towards the delivery connector 3 comprises on its outer surface fixing means *f* adapted to cooperate with complementary fixing means *j* provided on the inner surface of an axial housing 12 of the delivery connector 3 adapted to receive said end portion 11. In the assembled hydraulic head 1, the cylinder 2 and the connector 3 are coaxial.

The housing 12 of the delivery connector 3, bearing fixing means *j*, is situated in a portion *p* of this connector 3 engaged in the housing 5, as can be seen in the drawing.

Fixing means *f* and *j* are advantageously constituted by complementary threadings provided respectively on the outside of the portion 11 and on the inside of a housing 12. However, fixing means other than threading could be used for example a helicoidal ramp device cooperating with a pin or any other conventional device capable of being suited to the fixing envisaged.

As seen on the drawing, the delivery connector 3, intended to be connected to a pipe leading to the injectors of the pump, comprises a frustoconic outer portion 13 on which a mounting clamp (not shown) for the hydraulic head is adapted. Due to this clamp, the connector 3 is locked against the surface A or, if necessary, against the shim 6, itself supported against the surface A.

Inside the delivery connector 3, and at the neighbouring end of the cylinder 2, is arranged a delivery valve 14 adapted to permit the flow of fuel to the injectors when the pressure in the pump chamber 8 is sufficient. This delivery valve 14 comprises an outer collar 15 which is clamped between the front wall 16 of the end portion 11 of the cylinder 2 and a shoulder 17 inside the delivery connector 3. A sealing washer 18 is generally provided between this collar 15 and said shoulder 17.

As seen on the drawing, the inner shoulder 17 is situated axially substantially at the level of the inner edge of the shoulder 4 turned towards the casing C. As a result the collar 15 is situated substantially at the level of the surface A.

The locking of the cylinder 2 in the delivery connector 3 is ensured by means of the sealing-washer 18 and said collar 15. The cylinder 2 is in a way suspended from the delivery connector 3.

A deflector ring 19 is mounted free in rotation, around the cylinder 2, at the level of the two diametrically opposite orifices 20 provided in the wall of said cylinder to ensure the supply of fuel of the pump chamber 8. This ring 19 which, preferably, completely surrounds the cylinder 2, is mounted on two cylindrical collars 21, 22 provided on the outer surface of the cylinder 2, and of a diameter greater than the outer diameter of the end portion 11. These collars 21, 22 are situated axially outside the delivery connector and are separated from one another so that an annular gap forming a chamber 23 is created between these two collars. The orifices 20 open into this chamber 23. The deflector ring covers, longitudinally, this chamber 23 and includes orifices 24, shifted axially with respect to the orifices 20. As shown on the drawing, these orifices 24 are situated, with respect to the orifices 20 on the opposite side to the connector 3. Under these conditions, the jet of fuel projected violently through the orifices 20 at the end of injection is deviated by the wall of the ring 19 and flows, along a baffled path, through the orifices 24 so that the wall 25 of the fuel supply manifold in the casing is protected against erosion.

The housing *l* in which the deflector ring 19 is placed is bounded, at its axial end turned towards the connector 3, by the front wall 26 of the end of this connector. A friction washer 27 is arranged between this wall 26 and the ring 19 to facilitate the rotation of the latter and to avoid wear of said wall.

The housing *l* at its other end is limited by a shoulder 28 provided on the outside of a cylinder 2.

It is to be noted that play persists between the front wall 26 and the friction washer 27 so that the deflector ring 19 is not clamped axially and preserves its rotary freedom. Due to the possibility offered to the ring 19 of moving rotatively, the erosion produced by the jet of fuel coming from the orifices 20 and striking the inner wall of the ring 19 is distributed regularly over the whole inner prelimitor of this ring.

The fluid tightness between the hydraulic head and the wall of the housing 5 is ensured at two levels by two fluid tight seals 29, 30 arranged in grooves provided respectively at the periphery of the portion *p* of the connector 3 engaged in the housing 5 and on the periphery of the portion of the cylinder 2 situated on the side of the deflector ring 19 opposite the connector 3.

The seals 29, 30 are supported, externally, against the wall of the housing 5.

The orifices 20 are situated axially between the two sealing levels formed by the seals 29 and 30.

In a hydraulic head according to the invention, the connection of the delivery connector and of the cylinder is effected in simple manner.

Due to the fact that the cylinder 2 is in a way suspended in the delivery connector 3 and does not comprise any portion in abutment against the casing, a high degree of clamping of the delivery connector 3 and of the collar 4 of this connector due to the fixing clamp (not shown) can be effected without risk of deforming the bore of the cylinder 2 in which the piston 7 is intended to slide.

It is only necessary to ensure fluid tightness at two levels by the seals 29 and 30.

I claim:

1. A hydraulic head for a fuel injection pump including a casing defining a housing and a support surface, said head comprising: a cylinder defining a pump chamber and including at least one fuel supply orifice formed in the cylindrical side wall thereof, a pump piston disposed for movement within the cylinder, a delivery connector connected to the cylinder, said delivery connector including an external shoulder which cooperates with the support surface of the pump casing to provide an axial stop for the hydraulic head, said delivery connector further including an internal delivery valve and a depending housing having a threaded inner surface, the end portion of the cylinder facing the delivery connector being received in said housing of said delivery connector and including complementary threaded outer surface which engages the threaded inner surface of said housing so that, in the fully assembled hydraulic head, said cylinder is directly suspended from the delivery connector, said delivery connector also including an internal shoulder and said delivery valve of said delivery connector including an outer collar which is clamped between the end wall of the end portion of the cylinder adjacent to the delivery connector and said inner shoulder of the delivery connector.

2. A hydraulic head according to claim 1 further comprising a sealing washer provided between the collar and said inner shoulder of the delivery connector.

3. A hydraulic head according to claim 1 wherein the delivery connector includes a portion engaged in the pump housing in which the hydraulic head is received, said hydraulic head further including sealing means for providing a fluid tight seal between said portion of said delivery connector engaged in the pump casing housing and the wall of the pump casing housing, a second level of fluid-tightness being provided by a seal arranged directly between the cylinder and said wall of said pump casing housing, the fuel inlet orifice provided in the cylinder wall being located axially between the two seals.

4. A hydraulic head according to claim 1, further comprising a deflector ring, located axially at the level of the supply orifice of the cylinder and mounted for free rotation around the cylinder by means including an axially disposed friction washer.

* * * * *